United States Patent [19]

Wheeler

[11] Patent Number: 4,837,871

[45] Date of Patent: Jun. 13, 1989

[54] INFANT BATH SEAT

[76] Inventor: Johnny J. Wheeler, 814 E. Hayward, Independence, Mo. 64050

[21] Appl. No.: 132,598

[22] Filed: Dec. 14, 1987

[51] Int. Cl.[4] ..... A47K 3/024

[52] U.S. Cl. ..... 4/546; 4/572; 4/578

[58] Field of Search ..... 4/546, 547, 548, 549, 4/559, 560, 561, 564, 565, 566, 571, 572, 573, 574, 575, 578, 579, 589, 590, 604, 611, 562, 563; 297/441

[56] References Cited

U.S. PATENT DOCUMENTS

| | | | |
|---|---|---|---|
| 1,061,669 | 5/1913 | Hawk | 248/327 |
| 2,177,998 | 10/1939 | Schuette | 4/572 |
| 2,193,374 | 3/1940 | Notter | 4/572 |
| 2,237,177 | 4/1941 | Fischer | 4/572 |
| 2,460,308 | 2/1949 | Pribil | 4/572 |
| 2,503,938 | 4/1950 | Davis, Jr. | 4/572 |
| 2,562,628 | 7/1951 | McPeake, Jr. | 297/487 |
| 2,648,849 | 8/1953 | Webb et al. | 4/578 |
| 2,772,721 | 12/1956 | Saunders | 4/578 |
| 2,888,683 | 6/1959 | Medlock | 4/604 |
| 3,802,421 | 4/1974 | Williams | 4/559 |
| 4,150,445 | 4/1979 | Bailey | 4/546 |
| 4,426,113 | 1/1984 | Schutz | 297/441 |
| 4,719,653 | 1/1988 | Bishop et al. | 4/572 |

*Primary Examiner*—Henry J. Recla
*Assistant Examiner*—J. Casimer Jacyna
*Attorney, Agent, or Firm*—Litman, McMahon & Brown

[57] ABSTRACT

An infant bath seat includes a mounting assembly with a bottom track subassembly for mounting on a bathtub bottom and an upper track subassembly for mounting on a bathtub rim. A frame assembly includes a lower end mounting a wheel rollingly engaging the bottom track subassembly. The frame assembly also includes an outer end mounting a wheel rollingly engaging the upper track subassembly. A sling assembly is removably attached to the frame assembly for supporting an occupant in the bath seat.

10 Claims, 1 Drawing Sheet

INFANT BATH SEAT

BACKGROUND OF THE INVENTION

1. Field of the Invention.

This invention relatees generally to infant seats, and in particular to a rolling infant seat for removable installation in a bathtub.

2. Description of the Prior Art.

Infant bathing is often difficult or awkward due to a lack of effective cooperation from the infant. In an ordinary bathtub, relatively constant attention may be required to hold an infant in place and bathe it. A very young infant may not be able to support itself in an upright position, and even infants that can sit upright often will not sit still for a bath.

Infants are regularly bathed in full-size bathtubs, smaller infant-size bathtubs, sinks and various other vessels for retaining water, all of which have their disadvantages. For example, relatively small tubs or vessels may be inconvenient to store between uses, especially in bathrooms which often do not contain sufficient storage space. Many bathroom and kitchen sinks are suitable only for bathing relatively small infants. In a full-size bathtub an infant generally must be held constantly or it may splash, get soap in its eyes or submerge.

To overcome some of these disadvantages, infant supports for bathtubs have been proposed. For example, see: the Schutte U.S. Pat. No. 2,177,998; the Notter U.S. Pat. No. 2,193,374; the Fischer U.S. Pat. No. 2,237,177; the Pribil U.S. Pat. No. 2,460,308; the Davis, Jr. U.S. Pat. No. 2,503,938; and the McPeake, Jr. U.S. Pat. No. 2,562,628. However, heretofore there has not been available an infant bath seat with the advantages and features of the present invention.

SUMMARY OF THE INVENTION

In the practice of the present invention, an infant bath seat is provided for removable mounting in a bathtub including a bottom and an upper rim. A mounting assembly includes a bottom track subassembly mounted on the bathtub bottom and an upper track subassembly mounted on the bathtub upper rim. A frame assembly includes a pair of upright support standards each mounting a wheel rollingly engaging the bottom track subassembly and a pair of upright suspension standards connected to the support standards by cross beams. A pair of extensions project from the upright suspension standards and mount wheels for rollingly engaging the upper track subassembly. A back subframe is mounted on and extends upwardly from one of the cross beams. A sling assembly is removably fastened to the frame assembly and includes a seat portion for supporting an occupant of the bath seat and a back portion placed over the back subframe.

OBJECTS OF THE INVENTION

The principal objects of the present invention are: to provide an infant bath seat; to provide such a bath seat for mounting in a bathtub; to provide such a bath seat which is adapted to securely retain an infant in an upright position in a bathtub; to provide such a bath seat which facilitates bathing an infant; to provide such a bath seat which may be moved back and forth by either an infant occupying the bath seat or a person bathing the infant; to provide such a bath seat which is removable from a bathtub; to provide such a bath seat which may be easily installed in a bathtub; and to provide such a bath seat which is efficient in operation, capable of a long operating life, economical to manufacture and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction

Figure 1:
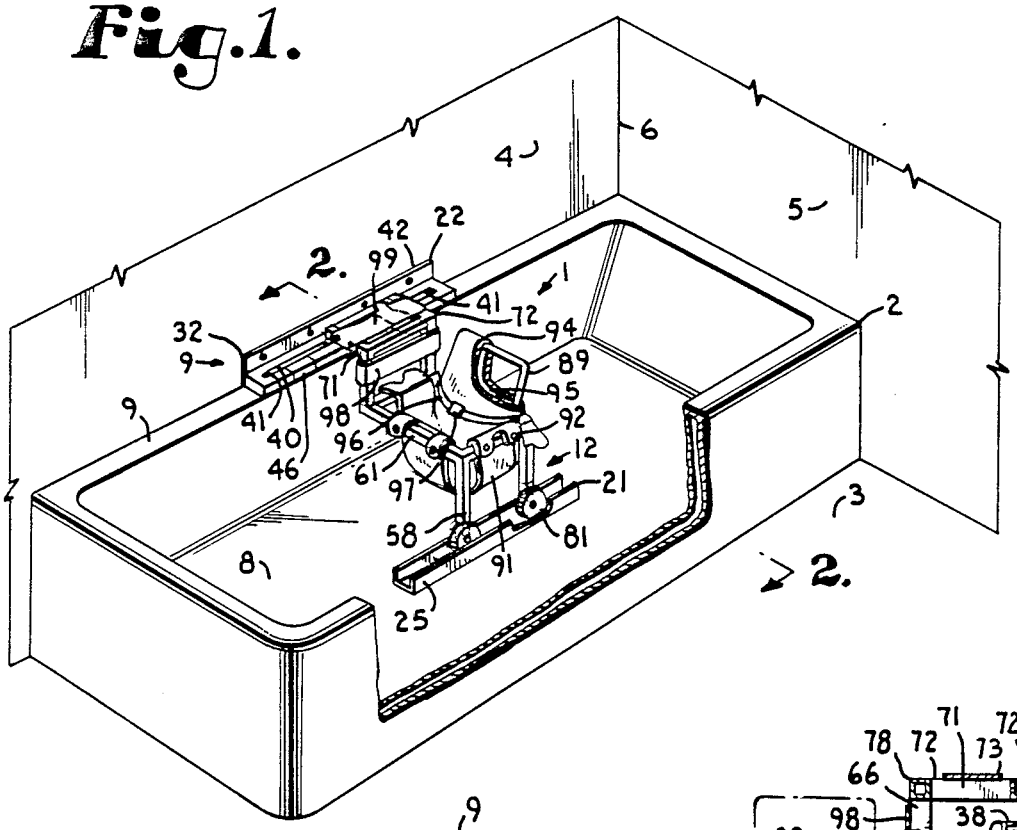
FIG. 1 is a perspective view of an infant bath seat embodying the present invention and shown mounted in a bathtub.
Figure 2:
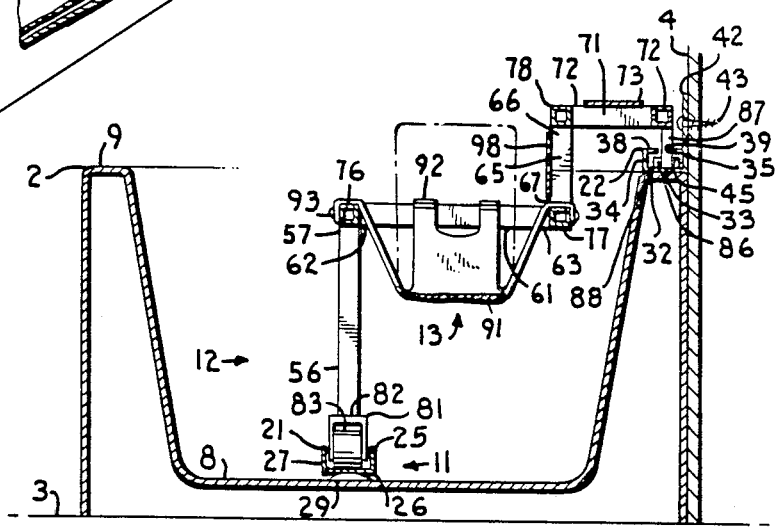
FIG. 2 is a transverse, cross-sectional view of the bath seat and the bathtub taken generally along line 2-2 in FIG. 1.

As required, detailed embodiments of the present invention are disclosed herein; it is to be understood that the disclosed embodiments are merely exemplary of the invention, which may be embodied in various forms. Therefore, specific structural and functional details disclosed herein are to be interpreted as limiting, but merely as a basic for the claims and as a representative basis for teaching one skilled in the art to variously employ the present invention in virtually any appropriately detailed structure.

Referring to the drawings in more detail, the reference numeral 1 generally designates an infant bath seat embodying the present invention. The seat 1 is adapted for mounting in a bathtub 2 supported on a floor 3 and placed against a back wall 4 and an end wall 5 forming a corner 6. The bathtub 2 includes a bottom 8 and a relatively flat rim 9.

The infant bath seat 1 generally comprises a mounting assembly 11, a frame assembly 12 and a sling assembly 13.

II. Mounting Assembly

The mounting assembly 11 includes a bottom track subassembly 21 removably secured to the bathtub bottom 8 and an upper track subassembly 22 mounted on the back wall 4 and the bathtub rim 9. The bottom track subassembly 21 includes a longitudinally-extending channel member 25 with a base 26 and opposite side flanges 27 forming an upwardly open channel 28. Suction cups 29 are mounted on the channel member base 26 for removably attaching the bottom track subassembly 21 to the bathtub floor 3.

The upper track subassembly 22 includes a longitudinally-extending track member 32 with a base 33, an inner side flange 34 and an outer side flange 35. A pair of opposed retainer legs 38 project towards each other from the side flanges 34, 35 and include spaced, opposed edges 39 defining a longitudinally-extending slot 40 with opposite closed ends 41. The outer side flange 35 projects upwardly from the level of the retainer legs 38 and forms a mounting plate 44 secured to the back wall 4 by screws 43.

Figure 3:
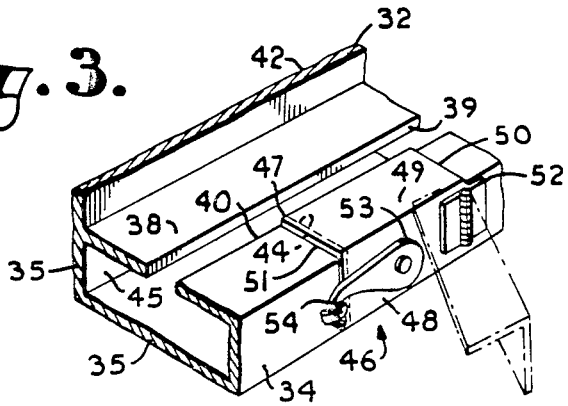
FIG. 3 is an enlarged, perspective view of a gate subassembly of the bath seat.

A pair of gate subassemblies 46 are provided on the track member 32 in longitudinally-spaced relation. As shown in FIG. 3, each gate subassembly 46 includes an angle section 47 with vertical and horizontal legs 48, 49 and proximate and distal ends 50, 51. The vertical leg 48 of each angle section 47 is mounted on a respective track member inner side flange 34 by a hinge 52 for swinging inwardly as shown in phantom in FIG. 3. A hook 53 is pivotally mounted on each vertical leg 48 for projecting from the angle section distal end 51 for selective engagement with a pin 54 projecting outwardly from the track member inner side flange 34. The hook 53 and the pin 54 are adapted to retain the gate assembly 46 in a closed position as shown in FIG. 3 whereat the angle section 47 closes the opening 44. With the hook 53 and the pin 54 disengaged, the angle section 47 can be swung to an inwardly-projecting open position as shown in phantom in FIG. 3.

III. Frame Assembly

The frame assembly 12 is preferrably formed from a relatively rigid, tubular material which is resistent to rust and corrosion, such as aluminum, stainless steel or plastic.

The frame assembly 12 includes a pair of upright support standards 56 with upper and lower ends 57, 58. A pair of cross members 61 include inner ends 62 attached to the upright support standard upper ends 57 and outer ends 63. A pair of upright suspension standards 65 include lower ends 67 attached to respective cross beams 61 and upper ends 66. A pair of extensions 71 include inner ends 72 attached to the cross beam inner ends 62 and outer ends 73. An inside lower longitudinal member 76 interconnects the support standard upper ends 57 and the cross beam inner ends 62; an outside lower longitudinal member 77 innerconnects the cross beam outer ends 63 and the support standard lower ends 67; an inside upper longitudinal member 78 innerconnects the suspension standard upper ends 66 and the extension inner ends 72; and an outside upper longitudinal member 79 interconnects the extension outer ends 73. The frame assembly 12 components 56, 61, 65, 71 and 76–79 are preferrably rigidly secured together by, for example, welding whereby the frame assembly 12 is relatively rigid.

A pair of lower wheel subassemblies 81 are mounted on the support standard lower ends 58 and each includes a clevis bracket 82 rotatably mounting a wheel 83. A pair of upper wheel subassemblies 86 each includes a strut 87 depending downwardly from a respective extension inner end 72 and rotatably mounting a pair of wheels 88. A back subframe 89 projects upwardly and rearwardly from the rearmost cross beam 61.

IV. Sling Assembly

The sling assembly 13 includes a seat portion 91 with six tabs 92; two tabs 92 each being attached to the frontmost cross beam 61, the inside lower longitudinal member 76 and the outside lower longitudinal member 77 by snap fasteners 93. A back portion 94 forms a pocket 95 for receiving the back subframe 89. A restraining belt 96 is fastened to the rearmost cross beam 61 and includes a buckle 97. Side and upper sling portions 98, 99 extend between the suspension standards 65 and the extensions 71 respectively and shield the upper track subassembly 22 from an occupant of the bath seat.

V. Operation

In operation the upper track subassembly 22 is preferably permantently mounted to the back wall 4, approximately centered longitudinally along the bathtub 2. The bottom track subassembly 21 is adapted for removable installation on the bottom 8 of the bathtub 2. The upper wheel subassemblies 86 are placed in the upper track member 32 through the open gate subassemblies 46, which are then locked with the hooks 53. With the gate subassemblies 46 locked in their closed positions, the upper wheel subassemblies 86 will be retained within the track member 32 by the retainer legs 38. The infant bath seat 1 is thus adapted to travel between a forwardmost position whereat the forwardmost strut 87 engages the forwardmost track member slot end 41 and a rearmost position whereat the rearmost strut 87 engages the rearmost track member slot end 41.

The infant bath seat 1 rolls freely on the wheel subassemblies 81, 86 in the track subassemblies 21, 22 respectively. The parallel track subassemblies 21, 22 cooperate with the longitudinally spaced wheel subassemblies 81, 86 to keep the infant bath seat 1 properly aligned as it rolls back and forth within the bathtub 2. Such back and forth movement is useful for entertaining an infant in the bath seat 1, and can be initiated by someone outside of the bathtub 2 or by the infant. Moving the infant bath seat 1 back and forth can be very beneficial since it improves coordination and helps to develop the motor skills of the infant. Furthermore, in a filled bathtub 2 an infant in the bath seat 1 will be partly buoyant which will make it relatively easy to roll the bath seat 1 back and forth. Still further, by using the bath seat 1 an infant can be instilled with confidence in the water. If necessary, the belt 96 can be used to retain an infant in the bath seat 1. The bottom track subassembly 21 can easily be removed for cleaning and normal use of the bathtub 2.

It is to be understood that while certain forms of the present invention have been illustrated and described herein, it is not to be limited to the specific forms or arrangement of parts described and shown.

What is claimed and desired to be secured by letters patent is as follows:

1. A bath seat for mounting in a bathtub including a bottom and a rim, which comprises:

(a) a mounting assembly including:
  (1) a bottom track subassembly adapted for mounting on said bathtub bottom; and
  (2) an upper track subassembly adapted for mounting on said bathtub rim;

(b) a frame assembly including:
  (1) an upright support standard with upper and lower ends;
  (2) a horizontal cross beam including an inner end attached to said support standard upper end and an outer end;
  (3) an upright suspension standard including a lower end attached to said cross beam outer end and an upper end;
  (4) an extension including an inner end attached to said suspension standard upper end and an outer end;
  (5) a lower wheel subassembly mounted on said support standard lower end and adapted for rollingly engaging said bottom track subassembly; and (6) an upper wheel subassembly mounted on said extension outer end and adapted for rollingly engaging said upper track subassembly;

(c) a sling assembly mounted on said cross beam and adapted for supporting an occupant of said bath seat; and (d) said bottom track subassembly including a channel member and a suction cup mounted on said channel member for releasable attachment to said bathtub bottom.

2. The bath seat according to claim 1 wherein said upper track subassembly includes:

(d) a track member forming a raceway adapted to rollingly receive said upper wheel subassembly.

3. The bath according to claim 1 wherein said upper track subassembly includes:

(e) means for retaining said upper wheel subassembly in said raceway.

4. The bath seat according to claim 3 wherein:

(f) said upper wheel subassembly includes a strut depending downwardly from said extension outer end and a wheel rotatably mounted on said strut; and (g) said retainer means comprises a pair of retainer legs terminating in spaced, opposed edges defining a slot therebetween, said slot receiving said strut and said retainer legs retaining said wheel within said raceway.

5. The bath seat according to claim 1, wherein:

(d) said upper track subassembly includes a mounting plate extending upwardly from said track member and adapted for attachment to a wall.

6. The bath seat according to claim 1, wherein said sling assembly includes:

(d) a seat portion; and (e) a snap fastener mounted on said seat portion and said cross beam for releasably mounting said seat portion on said cross beam.

7. The bath seat according to claim 1 wherein:

(d) said frame assembly includes a back subframe extending upwardly from said cross beam; and (e) said sling assembly includes a back portion forming a pocket adapted to receive said back subframe.

8. The bath seat according to claim 1, which includes:

(d) a retaining belt attached to said frame assembly and adapted for retaining an occupant in said bath seat.

9. A bath seat adapted for mounting in a bathtub including a bottom and a rim, which comprises:

(a) a mounting assembly including:

(1) a bottom track subassembly having a channel member defining an upwardly-open channel and a plurality of suction cups for releasably securing said channel member to said bathtub bottom;

(2) an upper track subassembly including a track member forming a longitudinally extending raceway and having a slot open to said raceway, said track member having a pair of openings communicating with said raceway;

(3) said upper track subassembly including a pair of gates each hingedly mounted to said track member adjacent a respective opening and moveable between an open position away from a respective opening and a closed position closing said opening, each said gate including a hook pivotally mounted thereon and a pin mounted on said track member, said hook being adapted to releasably engage said pin with said gate in its closed position; and (4) said track member slot having opposite, closed ends;

(b) a frame assembly including:

(1) a pair of upright support standards each having upper and lower ends;

(2) a pair of horizontal cross beams each having an inner end attached to a respective support standard upper end and an outer end;

(3) a pair of upright suspension standards each having a lower end attached to a respective cross beam outer end and an upper end;

(4) a pair of extensions each having an inner end attached to a respective suspension standard upper end and an outer end;

(5) a pair of lower wheel subassemblies each mounted on a respective support standard lower end and including a wheel for rollingly engaging said channel member in said channel;

(6) a pair of upper wheel subassemblies each including a strut attached to and depending downwardly from a respective extension outer end and a pair of wheels rotatably mounted on said strut and rollingly engaging said track member in said raceway, said struts being longitudinally, slidably received in said track member slot;

(7) said upper wheel assemblies being adapted to pass through said track member openings with said gates in their open positions;

(8) an inside lower longitudinal member attached to and extending between said support standard upper ends and said cross beam outer ends;

(9) an outside lower longitudinal member attached to and extending between said cross beam outer ends and said suspension standard lower ends;

(10) an inside upper longitudinal member attached to and extending between said suspension standard upper ends and said extension inner ends;

(11) an outside upper longitudinal member attached to and extending between said extension outer ends; and

(12) a back subframe attached to and extending upwardly from one of said cross beams;

(c) a sling assembly including:

(1) a seat portion;

(2) a plurality of tabs extending from said seat portion;

(3) a plurality of snap fasteners each attached to a respective tab and said frame assembly for releasably mounting said sling seat portion on said frame assembly;

(4) a back portion forming a pocket adapted to receive said back subframe;

(5) a side portion attached to and extending between suspension standards; and (6) an upper portion attached to and extending between said extensions; and (d) a belt attached to said frame assembly and including a buckle.

10. A bath seat for mounting in a bathtub including a bottom and a rim, which comprises:

(a) a mounting assembly including:

(1) a bottom track subassembly adapted for mounting on said bathtub bottom; and (2) an upper track subassembly adapted for mounting on said bathtub rim;

(b) a frame assembly including:

(1) an upright support standard with upper and lower ends;

(2) a horizontal cross beam including an inner end attached to said support standard upper end and an outer end;

(3) an upright suspension standard including a lower end attached to said cross beam outer end and an upper end;

(4) an extension including an inner end attached to said suspension standard upper end and an outer end;

(5) a lower wheel subassembly mounted on said support standard lower end and adapted for rollingly engaging said bottom track subassembly; and (6) an upper wheel subassembly mounted on said extension outer end and adapted for rollingly engaging said upper track subassembly;

(c) a sling assembly mounted on said cross beam and adapted for supporting an occupant of said bath seat;

(d) said upper track subassembly including a track member forming a raceway adapted to rollingly receive said upper wheel subassembly;

(e) said upper track subassembly including said track member having an opening adapted to pass said wheel and a gate hingedly mounted on said track member and movable between a closed position closing said track member opening and an open position opening said track member opening; and (f) said gate including a hook pivotally mounted on said gate and a pin mounted on said track member, said hook being adapted to releaseably engage said pin with said gate in its closed position.

* * * * *